United States Patent [19]

Gorham

[11] 3,977,592

[45] Aug. 31, 1976

[54] DIE CUT CONTAINER BLANK

[75] Inventor: Jack C. Gorham, Keokuk, Iowa

[73] Assignee: Hoerner Waldorf Corporation, St. Paul, Minn.

[22] Filed: Aug. 25, 1975

[21] Appl. No.: 607,243

[52] U.S. Cl. ..... 229/28 R; 229/15

[51] Int. Cl.[2] ..... B65D 5/48

[58] Field of Search ..... 229/27, 28 R, 15, 42

[56] References Cited

UNITED STATES PATENTS

| | | | |
|---|---|---|---|
| 2,690,285 | 9/1954 | Main | 229/15 |
| 2,998,179 | 8/1961 | Zilles | 229/27 |
| 3,049,279 | 8/1962 | Mairs et al. | 229/27 |
| 3,135,454 | 6/1964 | Struble et al. | 229/15 X |
| 3,166,229 | 1/1965 | Sherman et al. | 229/27 |
| 3,199,762 | 8/1965 | Coons | 229/27 |
| 3,228,581 | 1/1966 | Stegner | 229/27 |

*Primary Examiner*—Stephen P. Garbe

*Attorney, Agent, or Firm*—Jerry F. Best

[57] ABSTRACT

A one-piece die cut blank foldable into a rigid-sided container which has a four-cell divider located within the walls, wherein the divider panels are incorporated into the one-piece blank and are either foldable into position or are removable from the blank and inserted into a partition panel which is foldable from the blank.

2 Claims, 15 Drawing Figures

DIE CUT CONTAINER BLANK

BACKGROUND OF THE INVENTION

Field of the Invention

This relates to containers and blanks for making same which are foldable into a tubular box which is divided by partitions, where the partitions are formed integrally with the blank.

Description of the Prior Art

Boxes with partitions are of particular use throughout the packaging industry where it is desired to keep objects separated during shipment for purposes of protecting the items. In the past, it has been commonplace to erect the partition dividers and fit them together prior to assembly of the box, at which time they are then inserted into the erected container for filling. This required an assembly station with two separate inventories of box blanks and divider blanks. There is a need for a simplified one-piece blank which may be glued and folded so that the divider partitions are integral with the carton in its flattened state after gluing and warehousing and assembly of the box is simplified.

SUMMARY OF THE INVENTION

A one-piece blank which may be folded and glued to the flattened state and later erected into a container having four-cell partitions therein, where the partition panels are formed integrally with the box and are foldable into position or removable and insertable into slots to form a portion of the partition arrangement.

DETAILED DESCRIPTION OF THE PREFERRED EMBODIMENT

Figure 2:
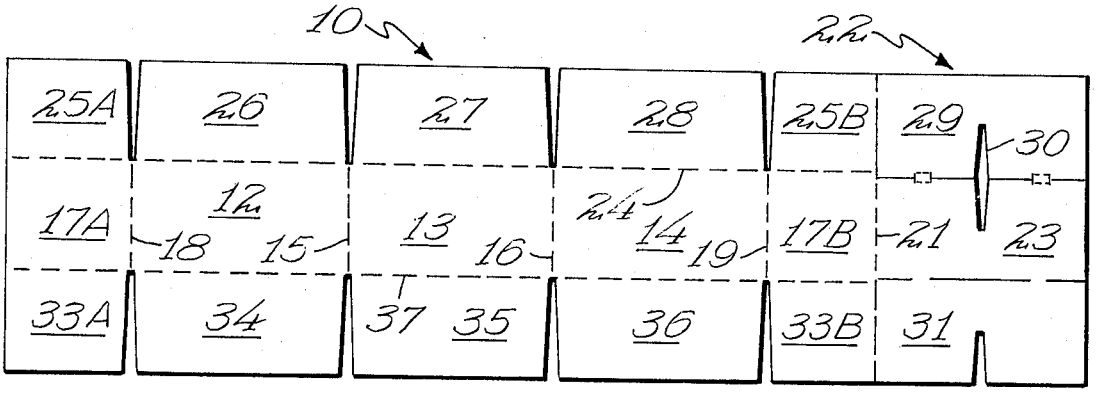
FIG. 2 is a plan view of a blank adapted to be erected into the container shown in FIG. 1.
Figure 3:
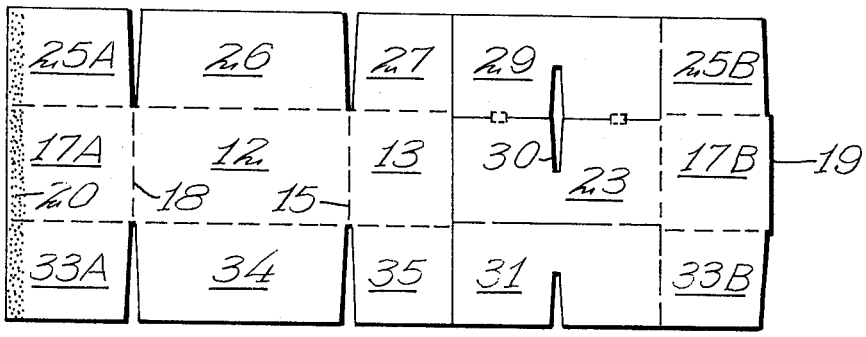
FIG. 3 is a plan view of the blank shown in FIG. 2, partially folded as a first step in the assembly of the carton.

The present disclosure includes two alternate embodiments of the same basic concept, that concept being the addition of a partition panel to one end of a die cut blank 10 with the manufacturer's joint being located in the middle of the side wall panel rather than the corner and having at least one removable section from that partition panel which is insertable into a slot at right angles to the main partition panel to form a four-cell divider in a standard rectangular tube-type carton. The blank shown in FIG. 2 is used to be folded into the container shown in FIG. 1, and includes three side-by-side rectangular side wall panels 12, 13 and 14 which are connected along parallel fold lines 15 and 16. The fourth side wall panel is divided in half and is labeled 17A and 17B with each half positioned at the outside lateral edge of the other three side wall panels and connected by fold lines 18 and 19 respectively. At the left hand side of the blank is a manufacturer's glue area 20 and on the right hand side of the blank, attached to the panel 17B along vertical fold line 21 is the partition blank labeled generally 22.

Figure 5:
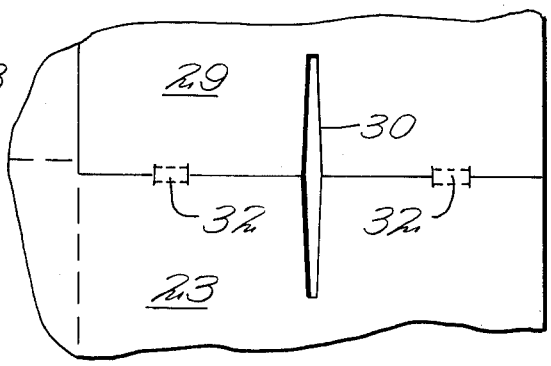
FIG. 5 is an expanded view of a portion of the die cut partition panels shown in FIG. 2.
Figure 1:
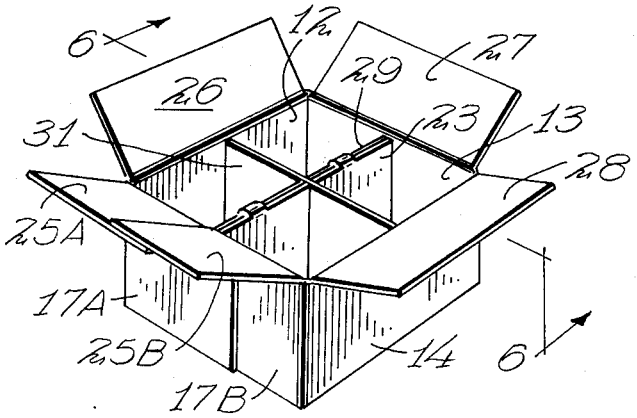
FIG. 1 is a perspective view of an assembled carton with the top flaps open embodying the present invention.
Figure 6:
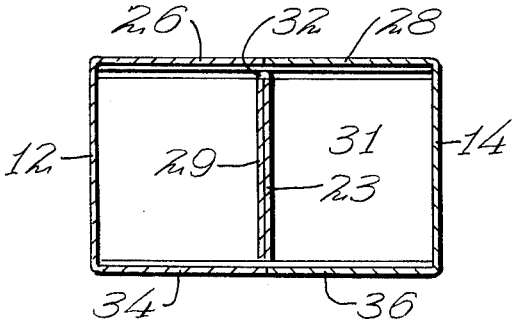
FIG. 6 is a side elevational section view of the carton shown in FIG. 1 with the top flaps folded downwardly into position and taken along section line 6—6 in FIG. 1.

This partition section 22 is formed in width substantially equal to the width of the other side wall panels since it must extend across the axis of the carton and includes a center section 23 which is hingedly attached along the fold line 21 and is formed in height substantially equal to the height of the other side wall panels. When the relative proportions of the container are such that the height of the side wall panels and the center partition 23 are substantially equal to the height of the closure flaps, which are located along the top edge of the blank and connected to the other side wall panels along the horizontal fold line 24, those top closure flaps being numbered 25A and 26, 27, 28 and 25B, respectively, the top member 29 in the partition section 22 may be formed so that it is detachable from the adjacent portion of the top flap 25B along a weakened line or separation and yet hingedly attached to the center section 23. It may be folded downwardly as seen in FIG. 1 to provide a double thickness partition wall with a center slot 30 formed therein. This center slot 30 is formed half way through the height of the panels 29 and 23 and is the insert for the bottom section 31 of the partition panel 22 which is completely removable from the adjacent panels along weakened lines of separation and is inserted into the slot 30 at right angles. The expanded view in FIG. 5 illustrates one technique for hinging the center and partition panels 23 and 29 and includes two small die cut hinges 32 which are made by locating parallel score lines parallel to the die cut line of separation. It should be understood that the top section 29 may be made removable so that the double thickness partition results from combining the partitions 29 and 31 and inserting them both into the slot formed in the center panel 23.

Figure 4:
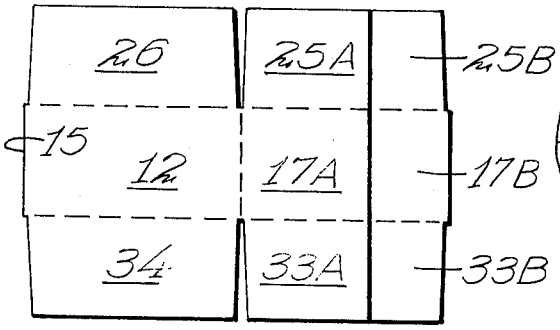
FIG. 4 is a plan view of the blank shown in FIGS. 2 and 3 shown in the next folding step and showing the container in its flat state.

The erection of the box is accomplished by first folding the right had side of the blank about the fold line 19 with subsequent folding of the right hand side of the blank 10 inwardly about the fold line 15 after applying adhesive to the glue area 20 to give the folded box blank shown in FIG. 4. The sides are then pushed out and the bottom closure flaps which are numbered 33A, 34, 35, 36 and 33B in FIG. 2 and are hingedly attached along the horizontal fold line 37 to form a conventional closure arrangement.

Figure 7:
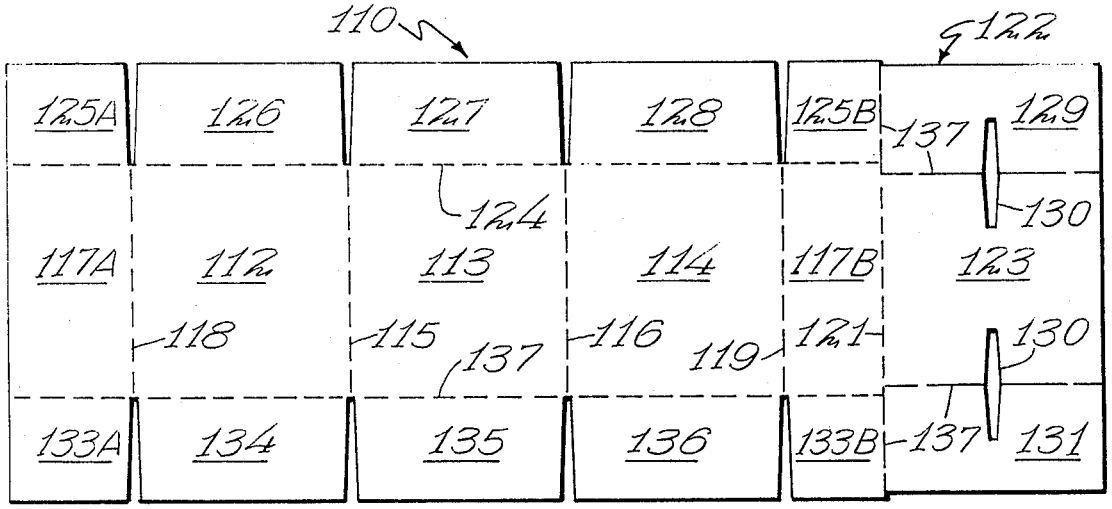
FIG. 7 is a plan view of a blank in a modified form embodying the present invention.

The alternate embodiment shown in FIGS. 7 through 15 is for the situation where the relative dimensions of the container require that the height of the side wall panels be approximately twice that of the end closure flaps. The blank in FIG. 7 is shown generally as 110 and is foldable in the carton labeled 111 in FIGS. 10 and 11 the blank 110 glues side wall panels 112, 113, and 114 with the split side wall being labeled 117A and 117B. The top closure flaps are labeled 125A, 126, 127, 128 and 125B and are attached along horizontal fold line 124. The bottom closure flaps are numbered 133A, 134, 135, 136 and 133B and are attached along the horizontal fold line 137. The left hand side of the blank has a glue area 120 and at the right hand side of the blank attached along the vertical fold line 121 is the partition section labeled generally as 122. The center section of the partition section 122 is labeled 123 and in the embodiment shown in FIG. 7, both the top and bottom partition panels 129 and 131 are removable along weakened lines of separation and have corresponding center slots formed part way therethrough which are numbered 130. The weakened lines of separation are shown in FIG. 7 as 137.

Figure 8:
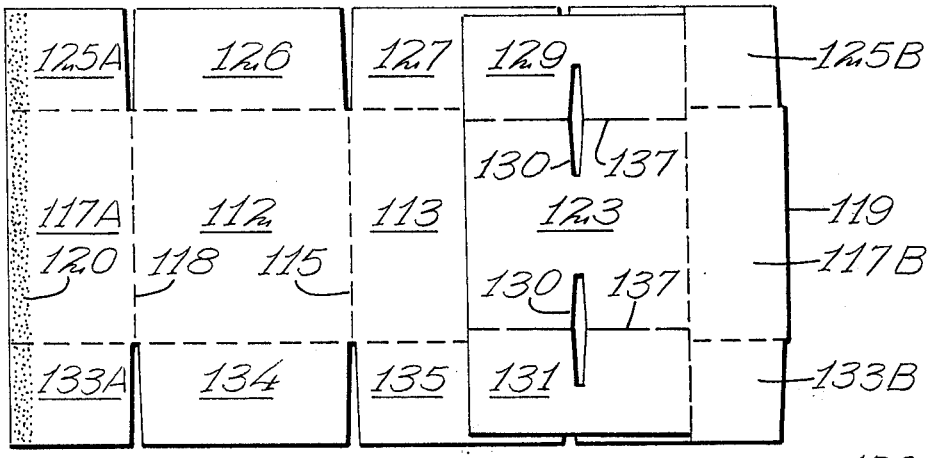
FIG. 8 is a plan view of the blank in FIG. 7 in a preliminary folding step during assembly.
Figure 9:
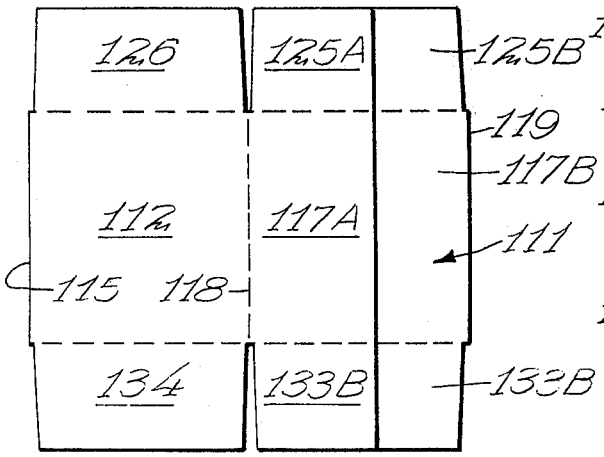
FIG. 9 shows the blank of FIG. 8 completely folded and glued in its knock-down state prior to erection.
Figure 10:
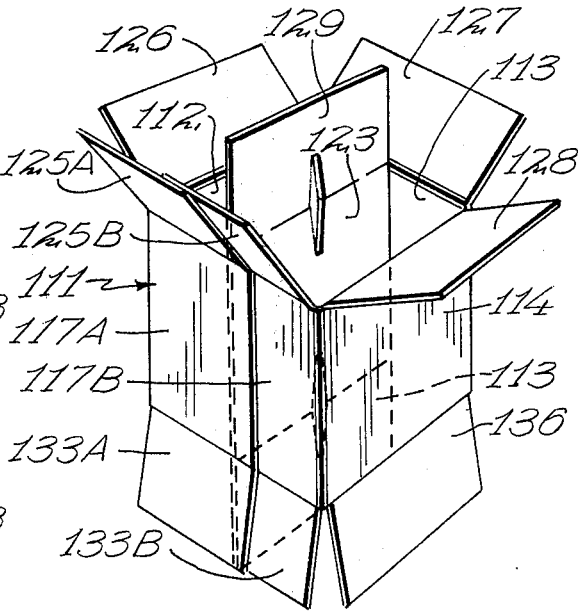
FIG. 10 is a perspective view of a carton erected from a blank such as that shown in FIGS. 7 through 9 prior to removal of the partition panels and closure of the end flaps.
Figure 11:
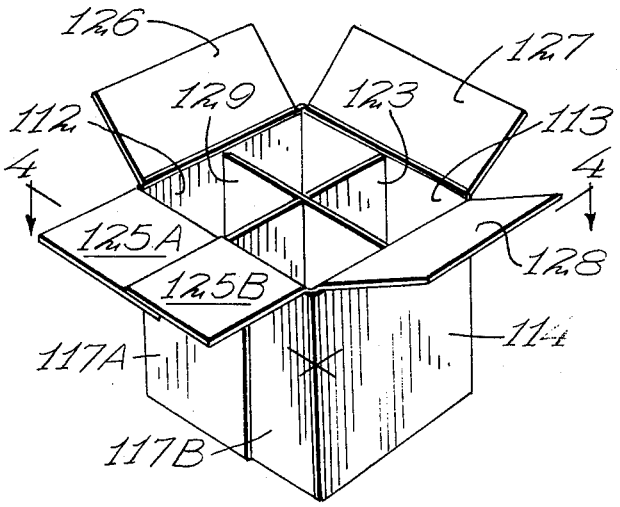
FIG. 11 is a perspective view of the container shown in FIG. 10 with the bottom closure flaps in position as well as the partition panels, with the top closure flaps left open.
Figure 14:
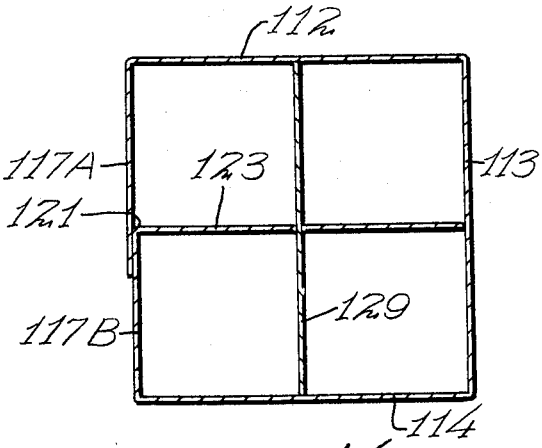
FIG. 14 is a plan view of the container as assembled shown in FIG. 11 taken along section lines 14—14 in FIG. 11.
Figure 15:
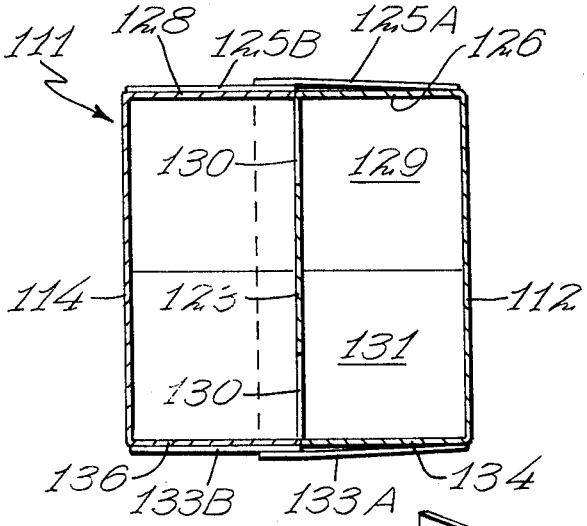
FIG. 15 is a side elevation section view of the container shown in FIG. 11, with the flaps closed and taken along section lines 15—15 in FIG. 11.
Figure 12:
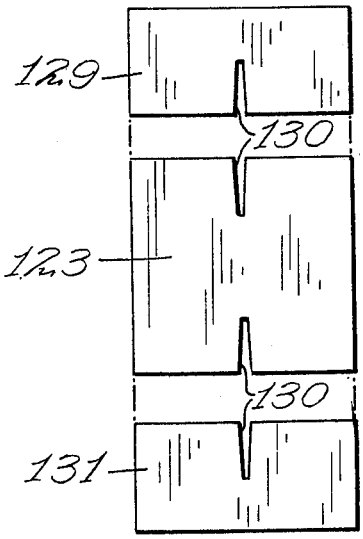
FIG. 12 illustrates how the partition panels in a portion of the blank shown in FIG. 7 are taken apart when the container is in the configuration shown in FIG. 10.
Figure 13:
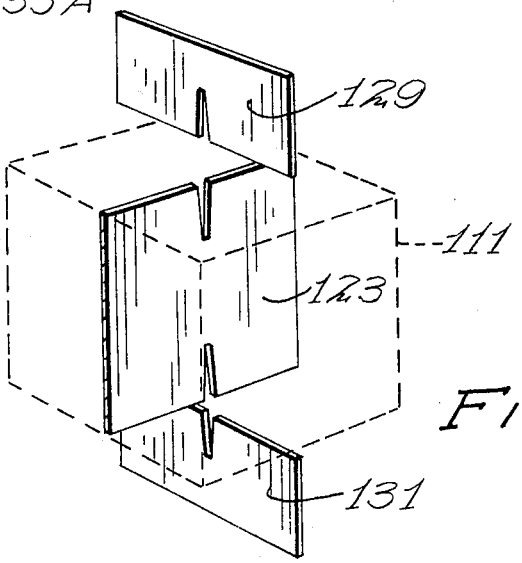
FIG. 13 is a perspective view, partly in outline, illustrating how the removable portion of the partition panels are inserted into position once the container is assembled.

The folding procedure as seen in FIGS. 8 and 9 are similar for the embodiment shown in FIG. 7 as for the blank 22 in FIG. 2, and includes folding the right hand side of the blank inwardly about the fold line 119 and the opposite side of the blank on top thereof about the fold line 115 to form the collapsed box blank of FIG. 9. In FIG. 10 it may be seen how the carton is opened to its tubular configuration and in FIG. 12 how the top and bottom panels 129 and 131 are detached from the center section 123 and, finally, in FIG. 13 how the removed top and bottom sections are inserted into the slots 130 to form the full length partition and the four-cell divider arrangement as seen best in FIG. 11. FIG. 14 illustrates the fact that there is only a single thickness of corrugated paperboard or whatever type of similar sheet-like material is used in both of the partition panels, and also it may be seen that the free end of the center section 123 is held in lateral position by the transverse members 129 and 131 prior to putting the contents in the carton 111.

I claim:

1. A blank of foldable sheet material for a square container having a four-cell divider therein, comprising:

three rectangular side wall panels connected in side-by-side relationship along vertical fold lines;

a fourth side wall panel made of two separate panel sections located at opposite ends of said three side wall panels, said panel sections formed in size to be an overlapping manufacturer's joint;

a center partition panel hingedly connected to one lateral edge of said blank along one of said panel sections;

at least one removable section hingedly attached along a horizontal weakened line of separation to said center partition panel; and said center partition panel and said removable section each having slots formed partially therethrough.

2. The blank of claim 1, including a fold-over section hingedly attached along a horizontal fold line to said center partition panel opposite said removable section, said fold-over section also having a slot formed partially therethrough.

* * * * *